US008536112B2

(12) United States Patent
Bernhardt et al.

(10) Patent No.: US 8,536,112 B2
(45) **Date of Patent: *Sep. 17, 2013**

(54) LIQUID CLEANING COMPOSITIONS CONTAINING SULFONATED ESTOLIDES AND ALKYL ESTER SULFONATES

(75) Inventors: Randal J. Bernhardt, Antioch, IL (US); Jeremy Aaron Weitgenant, Grayslake, IL (US); Gregory P. Dado, Chicago, IL (US); Dennis S. Murphy, Libertyville, IL (US)

(73) Assignee: Stepan Company, Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/416,747

(22) Filed: Mar. 9, 2012

(65) Prior Publication Data

US 2012/0172279 A1 Jul. 5, 2012

Related U.S. Application Data

(63) Continuation of application No. PCT/US2010/048484, filed on Sep. 10, 2010.

(60) Provisional application No. 61/241,710, filed on Sep. 11, 2009.

(51) Int. Cl.
*C11D 1/26* (2006.01)

(52) U.S. Cl.
USPC ..... 510/495; 556/95

(58) Field of Classification Search
None
See application file for complete search history.

(56) References Cited

U.S. PATENT DOCUMENTS

| | | | | |
|---|---|---|---|---|
| 6,018,063 | A | 1/2000 | Isbell et al. | |
| 6,172,026 | B1 | 1/2001 | Ospinal et al. | |
| 6,627,592 | B1 | 9/2003 | Shamayeli et al. | |
| 6,953,849 | B2 | 10/2005 | Vali et al. | |
| 7,666,828 | B2 * | 2/2010 | Bernhardt et al. | 510/495 |
| 7,879,790 | B2 | 2/2011 | Bernhardt et al. | |
| 7,884,064 | B2 | 2/2011 | Bernhardt et al. | |
| 7,998,920 | B2 | 8/2011 | Murphy et al. | |
| 8,058,223 | B2 | 11/2011 | Bernhardt et al. | |
| 8,119,588 | B2 | 2/2012 | Bernhardt et al. | |
| 8,124,577 | B2 | 2/2012 | Bernhardt et al. | |
| 8,129,328 | B2 | 3/2012 | Bernhardt et al. | |
| 8,338,358 | B2 | 12/2012 | Bernhardt et al. | |
| 2002/0039979 | A1 | 4/2002 | Aszman et al. | |
| 2004/0071653 | A1 | 4/2004 | Bratescu et al. | |
| 2004/0242920 | A1 | 12/2004 | Dado et al. | |
| 2007/0202069 | A1 | 8/2007 | Tamareselvy et al. | |
| 2008/0015135 | A1 | 1/2008 | Debuzzaccarini et al. | |
| 2009/0054294 | A1 | 2/2009 | Theiler et al. | |

FOREIGN PATENT DOCUMENTS

| | | | |
|---|---|---|---|
| CN | 1170433 | A | 1/1998 |
| EP | 0511091 | A1 | 10/1992 |
| GB | 1047772 | A | 11/1966 |
| GB | 1380390 | A | 1/1975 |
| WO | 0018363 | A1 | 4/2000 |
| WO | 0058430 | A1 | 10/2000 |
| WO | 0153247 | A1 | 7/2001 |
| WO | 2005113735 | A1 | 12/2005 |
| WO | 2006062665 | A1 | 6/2006 |
| WO | 2009094336 | A2 | 7/2009 |

OTHER PUBLICATIONS

Chinese Office Action, Appln No. 2010800506507, dated Jan. 17, 2013.
Int'l Search Report & Written Opinion for PCT/US2009/031455 dated Aug. 17, 2009.
Int'l Preli. Report on Patentability for PCT/US2009/031455 dated Aug. 5, 2010.
A.J. Stirton, et al: "Surface-active properties of salts fo alpha-sulphonated acids and esters" Journal of the American Oil Chemists' Society, vol. 13, No. 1, Jan. 1954, pp. 13-16, XP002537683.
Int'l Search Report & Written Opinion for PCT/US2009/031608 dated Oct. 29, 2009.
Int'l Preli. Report on Patentability for PCT/US2009/031608 dated Aug. 4, 2011.
Int'l Search Report & Written Opinion for PCT/US2009/051299 dated Oct. 20, 2009.
Int'l Preli. Report on Patentability for PCT/US2009/051299 dated Aug. 4, 2011.
Int'l Search Report & Written Opinion for PCT/US2009/051318 dated Oct. 22, 2009.
Int'l Preli. Report on Patentability for PCT/US2009/051318 dated Aug. 4, 2011.
Int'l Search Report & Written Opinion for PCT/US2009/051319 dated Oct. 20, 2009.
Int'l Preli. Report on Patentability for PCT/US2009/051319 dated Aug. 4, 2011.
Int'l Search Report & Written Opinion for PCT/US2009/051464 dated Oct. 22, 2009.
Int'l Preli. Report on Patentability for PCT/US2009/051464 dated Aug. 4, 2011.
Int'l Search Report & Written Opinion for PCT/US2010/029654 dated May 15, 2010.
Int'l Preli. Report on Patentability for PCT/US2010/029654 dated Feb. 2, 2012.
Int'l Search Report & Written Opinion for PCT/US2009/051294 dated Mar. 25, 2010.
Int'l Preli. Report on Patentability for PCT/US2009/051294 dated Feb. 2, 2012.
Int'l Search Report & Written Opinion for PCT/US2009/051312 dated Mar. 24, 2010.
Int'l Preli. Report on Patentability for PCT/US2009/051312 dated Feb. 2, 2012.

* cited by examiner

*Primary Examiner* — Necholus Ogden, Jr.
(74) *Attorney, Agent, or Firm* — McAndrews Held & Malloy, Ltd.

(57) ABSTRACT

Liquid cleaning compositions are described that comprise sulfo-estolide (SE) salts, particular sodium, lithium or ammonium salts of sulfo-estolides, and alkyl ester sulfonates. The liquid cleaning compositions are clear, stable and substantially free of precipitates due to the use of sodium, lithium or ammonium salts of sulfo-estolide rather than a potassium sulfo-estolide salt in the composition. The liquid cleaning compositions also have a total combined amount of saturated C16 and C18 fatty acids of less than about 5% by weight to prevent the formation of precipitates in the composition.

13 Claims, No Drawings

LIQUID CLEANING COMPOSITIONS CONTAINING SULFONATED ESTOLIDES AND ALKYL ESTER SULFONATES

RELATED APPLICATIONS

This application is a continuation of International application Serial No. PCT/US2010/048484 (International Publication No. WO 2011/032009), having an international filing date of Sep. 10, 2010. This PCT application claims priority to and claims benefit from U.S. provisional patent application Ser. No. 61/241,710 filed Sep. 11, 2009. The entire specifications of the PCT and provisional applications referred to above are hereby incorporated by reference.

BACKGROUND OF THE INVENTION

The present technology relates to compositions comprising sulfo-estolides, particularly salts of sulfo-estolides, and alkyl ester sulfonates. Such compositions, in general, are disclosed in U.S. application Ser. No. 12/507,011, which is herein incorporated by reference in its entirety. According to application Ser. No. 12/507,011, potassium is a preferred salt of sulfo-estolides for use in heavy duty liquid laundry concentrates because the potassium salt is significantly lower in viscosity than a comparable composition that contains the same amount of a sodium salt. Although such potassium salts of sulfo-estolides have desirable viscosity properties, they have an unexpected drawback in that they tend to form precipitates when used in compositions that also comprise alkyl ester sulfonates. Precipitates are undesirable for liquid cleaning compositions. In some cases the precipitates will settle to the bottom of the container holding the liquid cleaning composition. In other cases, the precipitate will be suspended throughout the composition. In either case, such precipitates are unacceptable whereas a liquid cleaning composition that is substantially free of settled precipitates is desired.

BRIEF SUMMARY OF THE INVENTION

Accordingly, one aspect of the present technology is a liquid cleaning composition that comprises sulfo-estolide salts and alkyl ester sulfonates which is substantially free of settled precipitates and has a percent transmittance of greater than about 50 at 570 nanometers measured in the absence of dyes and opacifiers at 25° C.

A further aspect of the present technology is a liquid cleaning composition that comprises sulfo-estolide salts and alkyl ester sulfonates wherein the sulfo-estolide salts are sodium, lithium or ammonium salts of sulfo-estolides, or mixtures thereof, and the liquid cleaning composition is substantially free of precipitates.

BRIEF DESCRIPTION OF SEVERAL VIEWS OF THE DRAWINGS

[Not Applicable]

DETAILED DESCRIPTION OF THE INVENTION

The present technology, in general, relates to sulfo-estolides. More particularly, the present technology relates to liquid cleaning compositions comprising sulfo-estolides and alkyl ester sulfonates that are substantially free of settled precipitates. The compositions described herein include, but are not limited to, sulfo-estolides having the structure of general Formula 1:

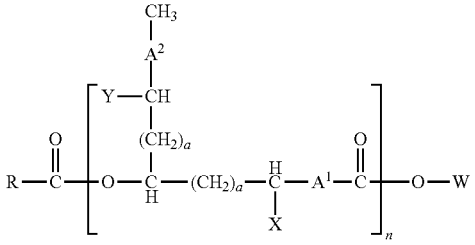

In general Formula 1:

n is an integer from about 1 to about 30, alternatively about 1 to about 10, alternatively 1 to 4, alternatively 1, 2, or 3, alternatively 1 or 2, alternatively 1; or a mixture thereof;

One of X and Y is $SO_3^-Z$, the other of X and Y is H (i.e., a hydrogen atom), and X and Y are independently assigned in each repeating unit;

$A^1$ and $A^2$ are independently selected linear or branched, saturated or unsaturated, substituted or unsubstituted alkyl diradicals, where the total number of carbons for each repeating unit is independent and in the range of $C_8$ to $C_{22}$. As defined here, the term "alkyl diradical" is meant to refer to a linking hydrocarbon or alkylene segment, for example but by no means limited to —$(CH_2)_3$—, —$(CH_2)_4$—, —$(CH_2)_5$—, and so forth;

a is 0, 1, or 2, and is independently assigned in each repeating unit. When a=0, 1, or 2, the functional group corresponds to an alpha-sulfo-estolide, beta-sulfo-estolide, or gamma-sulfo-estolide, respectively;

R can be linear or branched, saturated or unsaturated, substituted or un-substituted hydrocarbon, wherein the total number of carbon atoms can be from about 1 to about 24. In at least one embodiment, R has from about 7 to about 21 carbon atoms, alternatively from about 8 to about 16 carbon atoms, and can be a saturated or unsaturated linear or branched hydrocarbon, a linear or branched hydroxyalkane sulfonate, or a linear or branched alkene sulfonate. For example, in one embodiment, $A^1$ and $A^2$ are linear alkyl diradicals and R is saturated or unsaturated linear hydrocarbon, linear hydroxyalkane sulfonate, or linear alkene sulfonate having from about 7 to about 21, alternatively from about 8 to about 16 carbons;

W is a monovalent or divalent metal; ammonium; substituted ammonium; H; or a linear or branched, substituted or unsubstituted alkyl having from about 1 to about 22 carbon atoms. For example, W can be an alkali or alkaline earth metal cation. Alternatively, W can be a glycerine joined by an ester linkage, e.g., a substituted C3 alkyl such that the structure of general Formula 1 is incorporated one or more times as an ester in a monoglyceride, a diglyceride, or a triglyceride.

Z is H or a monovalent or divalent metal cation, ammonium or substituted ammonium cation, preferably an alkali or alkaline earth metal cation, for example potassium, sodium, calcium, or magnesium.

It has surprisingly been found that when the sulfo-estolides of general Formula 1 are used in combination with alkyl ester sulfonates in liquid cleaning compositions, the sodium salt (where W is sodium or H and Z is sodium in general Formula 1) results in a clear, substantially precipitate-free composition, whereas the potassium salt (where W is potassium or H and Z is potassium in general Formula 1) results in significant unacceptable precipitates. While not wishing to be bound by any particular theory, it is believed that, in solution, ionization of the sulfo-estolide salts and alkyl ester sulfonates occurs, and that there is enough ion exchange when the potassium salt of sulfo-estolides is used to cause potassium alkyl ester sulfonate salts to form. Because potassium alkyl ester sulfonates are significantly less soluble than sodium alkyl ester sulfonates, precipitates of potassium alkyl ester sulfonate are formed. When sodium sulfo-estolide salt is used in combination with alkyl ester sulfonates, no precipitates are formed, which is believed to be due to the higher solubility of sodium alkyl ester sulfonate compared to potassium alkyl ester sulfonate. Based upon known Krafft points for lithium and ammonium methyl ester sulfonates (Journal of the American Oil Chemists Society, 1965, 42, 1078), similarly clear, substantially precipitate-free compositions should be obtained when lithium or ammonium salts of sulfo-estolides are used as the sulfo-estolide component in the liquid cleaning composition.

The precipitates that form when a potassium sulfo-estolide salt is used in combination with a methyl ester sulfonate surfactant can settle to the bottom of the container holding the liquid cleaning composition. Such settled precipitates are undesirable for a liquid cleaning composition and it is preferable that the liquid cleaning composition be substantially free of settled precipitates. By "substantially free" is meant that there are no settled precipitates visible to the naked eye.

In some cases precipitates can be evenly suspended throughout the composition. As a measure of suspended, unacceptable precipitate for the compositions of the present technology, it is desirable to have a percent transmittance of light of greater than about 50 using a 1 centimeter cuvette at a wavelength of 570 nanometers wherein the composition is measured in the absence of dyes and opacifiers at 25° C. Alternatively, transparency of the composition may be measured as having an absorbance (A) at 570 nanometers of less than about 0.3 which is in turn equivalent to percent transmittance of greater than about 50 using the same cuvette as above. The relationship between absorbance and percent transmittance is:

$$\text{Percent Transmittance}=100(1/\text{inverse log } A)$$

Compositions of the present technology are clear, transparent and desirably have a percent transmittance of greater than about 50 at a wavelength of 570 nanometers when measured in the absence of dyes and opacifiers at 25° C.

Sulfo-Estolide Component

A suitable starting material for preparing the sulfo-estolide salt used in the compositions of the present technology is a fatty acid (fatty carboxylic acid). Fatty acids that may be suitable for use in the present technology include but are not limited to linear unsaturated fatty acids of about 8 to about 24 carbons, branched unsaturated fatty acids of about 8 to about 24 carbons, or mixtures thereof. Unsaturated fatty acids provided from commercial sources containing both saturated and unsaturated fatty acids are suitable for use in the present technology. Mixtures of saturated fatty acids and unsaturated fatty acids are also contemplated. In a non-limiting example, fatty acid mixtures that are rich in oleic acid (cis-9-octadecenoic acid) are suitable feedstocks. Other unsaturated fatty acids, for example but not limited to, trans-octadecenoic acids or palmitoleic acid may also be employed in the presently described technology.

Suitable feedstocks may be derived from vegetable and/or animal sources, including but not limited to fatty acids and fatty acid mixtures derived from canola oil, corn oil, cottonseed oil, linseed oil, olive oil, palm oil, peanut oil, rapeseed oil, safflower oil, sesame oil, soybean oil, sunflower oil, tall oil, tung oil, lard, poultry fat, BFT (bleachable fancy tallow), edible tallow, coconut oil, cuphea oil, yellow grease and combinations of these. Also contemplated are genetically modified or engineered oils that include, but are not limited to high oleic sunflower or soybean oil. In some embodiments, the preferred unsaturated fatty acid feedstocks may contain reduced levels of polyunsaturated fatty acids, for example, less than 15%, alternatively less than 10%, alternatively less than 5% on a total weight basis. In some additional embodiments, the fatty acid feedstocks may be obtained by the partial hydrogenation of unsaturated triglycerides, for example soybean oil, followed by hydrolysis of the oil to afford fatty acids that are enriched in monounsaturated fatty acids and depleted in polyunsaturated fatty acids. The above-noted triglycerides optionally hydrogenated, can also be used as feedstocks, alone or in combination with fatty acids. Suitable feedstocks may also include those that contain saturated fatty acids. However, because excess saturated C16/C18 fatty acids in the final product composition can result in an unstable product, as explained more fully below, it is desirable to limit the amount of saturated fatty acids in the feedstock so that when the resultant sulfo-estolide is incorporated into a composition, the total saturated fatty acid content in the composition is less than about 5%, preferably less than about 3%, and most preferably less than about 1%. Further, the feedstocks may be enriched in mono unsaturated fatty acids, for example, via distillation; however, undistilled feedstocks are preferred due to lower cost.

The compounds of general Formula 1 and related compounds (for example, where n=0) can be made, for example, by: a) $SO_3$ sulfonation of a fatty acid, for example oleic acid; b) neutralization with aqueous caustic to afford a sulfonate salt solution with a pH in the range of about 4 to about 10; and c) hydrolysis of the resulting sultones, maintaining the reaction mixture at a pH of about 4 to about 10. Sulfonation can be carried out, for example, using a falling film $SO_3$ process or other continuous $SO_3$ sulfonation processes.

The sulfo-estolide produced from sulfonation can be immediately transferred to a vessel or reactor, for example a continuous neutralizer ("CN"), for the purpose of neutralizing sulfonic acids and at least a portion of the carboxylic acids that are present. Alternatively, aging of the sulfo-estolide sulfonic acid may be provided for the purpose of modifying the composition of the acid, particularly with regard to an increase in the amount of esters wherein X and Y within one or more repeating units, in general Formula 1, are both H. Neutralization of the acids is accomplished by reaction with aqueous base, for example but not limited to aqueous NaOH, ammonium hydroxide, and metal carbonates. Although aqueous KOH is also a known base for neutralization, KOH is not a desirable base for use in the present technology since potassium sulfo-estolides form precipitates when used in combination with alkyl ester sulfonates, as described above. In some embodiments, the amount of alkali that may be used in the neutralization is an amount that provides a neutralized product with a pH of about 4 to about 10. In these embodiments, the neutralized reaction mass may be produced in a way that minimizes the hydrolysis of carboxylic esters. In at least some of these embodiments, the amount of carboxylic ester hydrolysis that may occur may approach zero. When utilized, the CN may be operated with a mass fraction of acid of from about 0.1 to about 0.8, optionally about 0.5. The process can be carried out at a temperature of about 20° C. to about 100° C., alternatively about 40° C. to about 70° C. The free alkalinity level, as measured by titration with aqueous HCl to a bromophenol blue endpoint, optionally using potash (potassium hydroxide) as the caustic, can be from 0 to about 3.5 wt. %, optionally about 2.5 wt. %. Note that all percentages are by weight in this specification, unless otherwise indicated. In a non-limiting example, the final average additions to the CN can be approximately 50% sulfo-estolide sulfonic acid, 35% water, and 15% caustic (50% concentration).

Hydrolysis of Sultones

The neutralized sulfo-estolide product can be subjected to a hydrolysis step for the purpose of hydrolyzing sultones, sulfonic acid esters, and acid anhydrides. This sultone hydrolysis step may be conducted under conditions that prevent significant sultone hydrolysis of carboxylic esters in the product. The temperature of the sultone hydrolysis reaction mixture may be from about 20° C. to about 140° C., alternatively from about 50° C. to about 90° C. In some embodiments, the pH of the reaction mixture may be maintained in the range of about 4 to about 10 throughout the course of reaction without the need to add additional caustic. In some additional embodiments, additional caustic may be added to ensure that the pH is maintained in the range of about 4 to about 10. The sultone hydrolysis may be conducted in a continuous or batch process method and may be conducted for an amount of time necessary to result in a stabilized level of free alkalinity, as may be judged, for example, by titration to bromophenol blue endpoint with aqueous HCl.

It is contemplated that hydrolysis of sultones may be conducted at a pH above about 10 without substantial carboxylic ester hydrolysis provided that the reaction temperature and free caustic are maintained sufficiently low.

Neutral Bleaching

In at least one embodiment, bleaching of neutralized products of sulfo-estolides may be conducted by treating the products with aqueous hydrogen peroxide, for example 35% $H_2O_2$, in a bleaching reaction that is conducted at a temperature of about 20° C. to about 150° C., alternatively about 50° C. to about 120° C., alternatively about 70° C. to about 100° C. Alternatively, metal hypochlorite, ozone, or any other oxidant or other material that is effective as a bleaching agent may be used. The hydrogen peroxide or alternative oxidizing agent may be used in any amount that is effective in providing a desired color reduction. For example, aqueous hydrogen peroxide may be added to provide about 0.05% to about 5% by weight active hydrogen peroxide, alternatively from about 0.1% to about 3%. The bleaching of the neutralized product may be conducted in the same step as the sultone hydrolysis, or may be conducted in a separate step. For example, if carried out concurrently, hydrogen peroxide can be added at about 2% (wt/wt) concentration (at 100% active) to a reaction vessel used to conduct sultone hydrolysis. The free alkalinity and free peroxide can be measured periodically until the targeted % free alkalinity level, for example 1.8%-2.0% is reached. If the % free alkalinity is lower than the target before sultone hydrolysis is complete, then an additional amount of base can be added to maintain the target levels. In at least one embodiment, it is preferable that the amount of free peroxide in the reaction mixture be maintained above about 20 ppm, alternatively above about 100 ppm, alternatively above about 500 ppm, so as to avoid discoloration of the reaction mass, adding additional amounts of hydrogen peroxide if necessary.

If required or desired, additional hydrogen peroxide can be added after sultone hydrolysis is completed for the purpose of enabling additional bleaching of the sultone hydrolyzed product. If required or desired, a reducing agent such as $SO_2$ or sulfurous acid, or metal salts thereof, can be added at or near the end of the bleaching step in order to reduce residual free peroxide to a desired level.

In accordance with some embodiments, it is preferable to conduct the bleaching of neutralized products of sulfo-estolides with hydrogen peroxide at a pH in the range of about 4.5 to about 7.5, alternatively about 5 to about 7, wherein these ranges correspond to pH values measured on diluted samples, for example about 1 wt % or about 2 wt % of sample diluted in water. Preferably, the pH of the bleaching reaction mixture is maintained, at least initially, below a pre-determined level that is necessary to minimize hydrogen peroxide decomposition, to prevent severe foaming of the reaction mixture, and to improve color reduction. It has been found that if the pH of the bleaching reaction mixture is at and above that pre-determined level, at least during the initial stage of bleaching reaction, substantial peroxide decomposition and severe foaming occurs. Without intending to be bound by any particular theory, it is believed that such decomposition and severe foaming may be dependent on a number of factors, including dissolved metal ions in the reaction mixture, exposure to metal reaction equipment surfaces, and bleaching reaction temperature. It is contemplated that the decomposition of bleaching agent may be altered or mitigated through the incorporation of stabilizers, including but not limited to metal chelating agents, or alternatively through the passivation of metal surfaces or the use of non-metal surface process equipment.

The resulting sultone hydrolyzed product is a salt of sulfo-estolides (SE) that can be used to formulate the liquid cleaning compositions of the present technology.

Alkyl Ester Sulfonates

In addition to the sulfo-estolide salts, the present compositions also comprise one or more alkyl ester sulfonates. The preferred alkyl ester sulfonate surfactants, especially for laundry applications, comprise alkyl ester sulfonate surfactants of the structural formula:

$$R^3—CH(SO_3M)-C(O)—OR^4$$

where $R^3$ is a $C_8$-$C_{20}$ hydrocarbyl, preferably an alkyl or combination thereof, $R^4$ is a $C_1$-$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$-$C_{16}$ alkyl, and $R^4$ is methyl, ethyl or isopropyl. The alkyl group $R^3$ may have a mixture of chain lengths. Alkyl ester sulfonates can be provided as blends of compounds with different $R^3$ substitutents. For example, a C12-C18 alkyl ester sulfonate indicates a blend of compounds having $R^3$ substitutents of $C_{12}$, $C_{18}$ and lengths in between. Examples of alkyl ester sulfonate blends include the methyl ester sulfonates where $R^3$ is $C_{10}$-$C_{16}$ alkyl, $C_{10}$-$C_{18}$ alkyl, or $C_{12}$-$C_{18}$ alkyl. Suitable alkyl ester sulfonates include predominantly (>50%) C12 alpha methyl ester sulfonate, predominantly (>50%) C16 alpha methyl ester sulfonate, and blends of predominantly C12 and predominantly C16 alkyl ester sulfonates. A preferred alkyl ester sulfonate is sodium methyl-2 sulfo C12-C18 ester. Furthermore, alkyl ester sulfonates can be provided in compositions comprising other surfactants. For example, for many embodiments and formulations, a preferred commercially available component is ALPHA-STEP PC-48 (available from Stepan Co., Northfield, Ill.), which includes sodium methyl-2 sulfo C12-C18 ester and disodium 2-sulfo C12-C18 fatty acid.

Other suitable anionic surfactants that can be used are alkyl ester sulfonate surfactants including linear esters of $C_8$-$C_{20}$ carboxylic acids (i.e., fatty acids) which are sulfonated with gaseous $SO_3$ according to "The Journal of the American Oil Chemists Society," 52 (1975), pp. 323-329. Suitable starting materials include natural fatty substances as derived from tallow, palm oil, or other vegetable and/or animal sources.

Alkyl ester sulfonates also include fatty acid ester sulfonates, which are represented by the formula:

$$R^4CH(SO_3M)CO_2R^5$$

where $R^4$ is an alkyl group of 6 to 16 atoms, $R^5$ is an alkyl group of 1 to 4 carbon atoms and M is a solubilizing cation. The group $R^4$ may have a mixture of chain lengths. Preferably at least two-thirds of these groups have 6 to 12 carbon atoms. This will be the case when the moiety $R^4CH(-)CO_2(-)$ is derived from a coconut source, for instance. It is preferred that $R^5$ is a straight chain alkyl, notably methyl or ethyl.

In various embodiments of the present technology, the formulations can include one or more alkyl ester sulfonates in the amounts of from about 0.1% to about 90% by active weight; alternatively from about 2% to about 70% by active weight; alternatively from about 5% to about 45% by active weight; alternatively, from about 10% to about 30% by active weight based on the total weight of the composition. More particularly, formulations comprising one or more alkyl ester sulfonate in concentrations of at least about 0.1% by weight, alternatively at least about 0.2% by weight, alternatively at least about 0.5% by weight, alternatively at least about 1% by weight, alternatively at least about 2% by weight, alternatively at least about 4% by weight, alternatively at least about 5% by weight, alternatively at least about 10% by weight, are contemplated, as are formulations comprising at least about 0.1% by weight, alternatively at least about 0.2% by weight, alternatively at least about 0.5% by weight, alternatively at least about 1% by weight, alternatively at least about 2% by weight, alternatively at least about 5% by weight, are contemplated, as are concentrations of at most about 99.9% by weight, alternatively at most about 95% by weight, alternatively at most about 90% by weight, alternatively at most about 70% by weight, alternatively at most about 50% by weight, alternatively at most about 40% by weight, alternatively at most about 30% by weight, alternatively at most about 20% by weight. Any of the foregoing minimums and maximums can be combined to recite a range for the concentration of alkyl ester sulfonates in a formulation.

Liquid Cleaning Formulations

The sulfo-estolide salts, preferably the sodium salt of sulfo-estolide, and the alkyl, preferably methyl, ester sulfonate surfactants described above are formulated into liquid cleaning compositions that are clear, stable and free of precipitates. In order to control the stability of the final, liquid cleaning composition, it is important to limit the amount of saturated C16 and C18 fatty acids (or soaps formed from the fatty acids) that the sulfo-estolide salt contributes to the final liquid cleaning composition. It has been found that when too much of the combination of these materials is present, the composition is not stable and the materials will precipitate from the composition. It is therefore desirable to minimize the amount of the combined total percent of saturated C16 and C18 fatty acids in the final, liquid cleaning composition.

Preferably the combined total percent of saturated C16 and C18 fatty acids is less than about 5%, preferably less than about 3%, alternatively less than about 1% by weight of the final liquid cleaning composition. One method of limiting the percent of saturated C16 and C18 fatty acids present in the final composition is to limit the percent of saturated C16 and C18 fatty acids in the feedstock used to synthesize the sodium sulfo-estolide salt. The amount of saturated C16 and C18 fatty acids that can be present in the feedstock will depend in part on the amount of sodium sulfo-estolide salt that will be used in the liquid cleaning composition. The greater the amount of sodium sulfo-estolide to be used in the liquid cleaning composition, the lower the percent of saturated C16 and C18 fatty acids that should be used in the feedstock in order to insure that the percent of saturated C16 and C18 fatty acid material present in the final composition is less than about 5%, preferably less than about 3%, and most preferably less than about 1%.

A wide variety of liquid cleaning compositions can be made that include the sulfo-estolide salt, preferably sodium sulfo-estolide salt, and alkyl, preferably methyl, ester sulfonate components, with or without other ingredients as specified below. Formulations are contemplated that comprise 1% to 98%, more preferably between 1% and 50%, alternatively between 1% and 30% by weight of the sulfo-estolide salt, and 1% to 70%, more preferably between 1% and 60%, alternatively between 1% and 40% by weight of the alkyl ester sulfonate surfactant, with 98% to 1%, preferably 90% to 10% by weight water and, optionally, other ingredients as described herein.

In addition to the sodium or other sulfo-estolide salt and alkyl ester sulfonate surfactant, other components commonly contained in liquid cleaning products are contemplated for formulating the liquid cleaning products of the present technology. For example, the liquid cleaning compositions can comprise other surfactants, including anionic, cationic, nonionic, ampholytic and zwitterionic surfactants, and mixtures thereof, builders, alkaline agents, enzymes, adjuvants and cleaning adjuncts, and perfumes and dyes. Preferred additional surfactants include alcohol ethoxylates, alkyl polyglucosides, alkyl ether sulfates and linear alkyl benzene sulfonates. Such additional components are described in detail in U.S. application Ser. No. 12/507,011, incorporated herein by reference.

"Anionic surfactants" are defined here as amphiphilic molecules with an average molecular weight of less than about 10,000, comprising one or more functional groups that exhibit a net anionic charge when in aqueous solution at the normal wash pH, which can be a pH between 6 and 11. The anionic surfactant used in the present technology can be any anionic surfactant that is substantially water soluble. "Water soluble" surfactants are, unless otherwise noted, here defined to include surfactants which are soluble or dispersible to at least the extent of 0.01% by weight in distilled water at 25° C. It is preferred that at least one of the anionic surfactants used in the present technology be an alkali or alkaline earth metal salt of a natural or synthetic fatty acid containing between about 4 and about 30 carbon atoms. It is especially preferred to use a mixture of carboxylic acid salts with one or more other anionic surfactants. Another important class of anionic compounds is the water soluble salts, particularly the alkali metal salts, of organic sulfur reaction products having in their molecular structure an alkyl radical containing from about 6 to about 24 carbon atoms and a radical selected from the group consisting of sulfonic and sulfuric acid ester radicals.

Preferred additional surfactants for use in laundry detergent compositions include, for example, Steol CS-270 (lauryl 2-mole average ether sulfonate), Steol CS-170 (lauryl 1-mole average ether sulfonate), Steol CS-330 (lauryl 3-mole average ether sulfonate), Bio-Soft EC-690 (alcohol ethoxylate), Bio-Soft D-40 (sodium alkylbenzenesulfonate), Bio-Soft S-101 (alkylbenzene sulfonic acid) neutralized with sodium, potassium, ammonium and/or magnesium, Bio-Terge AS-40 (sodium olefin sulfonate), Alpha-Step PC-48 (alkyl methyl ester sulfonate) and/or Stepanol WA-Extra K (sodium lauryl sulfate), all from the Stepan Company, Northfield, Ill. The amount of anionic surfactant contemplated can be, for example, 1% to 70% of the composition more preferably between 1% and 60%, even more preferably between 1% and 40%.

Cationic Surfactants

Specific cationic surfactants contemplated for use in the present compositions include ditallow dimethylammonium chloride (DTDMAC), fatty alkanolamides (FAA), and quaternized diesters of trialkanolamines and fatty acids. The proportions of cationic surfactants used in a formulation can range, for example, from 0.1% to 20%, more preferably between 1% and 10%, even more preferably between 1% and 5%. See also P&G U.S. Pat. No. 5,929,022; column 6, 2nd paragraph through column 7, 1st paragraph, from which much of the following discussion comes:

Cationic detersive surfactants suitable for use in the present compositions, particularly laundry detergent compositions of the present technology, include those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

where $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$-$C_4$ alkyl, $C_1$-$C_4$ hydroxyalkyl, benzyl ring structures formed by joining the two $R^4$ groups, —$CH_2CHOH$—$CH(OH)C(O)R^6CH(OH)CH_2OH$ where $R^6$ is any hexose or hexose polymer having a molecular weight less than about 1000, and hydrogen when y is not 0; $R^5$ is the same as $R^4$ or is an alkyl chain where the total number of carbon atoms of $R^2$ plus $R^5$ is not more than about 18; each y is from 0 to about 10 and the sum of the y values is from 0 to about 15; and X is any compatible anion. The long chain cationic surfactant can also be the quaternized version of stearamidopropyl dimethylamine (e.g. stearamidopropyl trimethylamine chloride).

Preferred cationic surfactants are the water-soluble quaternary ammonium compounds useful in the present composition having the formula:

$$R^1R^2R^3R^4N^+X^-$$

where $R^1$ is $C_8$-$C_{16}$ alkyl, each of $R^2$, $R^3$ and $R^4$ is independently $C_1$-$C_4$ alkyl, $C_1$-$C_4$ hydroxyalkyl, benzyl, or —$(C_2H_4O)_xH$ where x has a value from 1 to 5, and X is an anion. In an embodiment, not more than one of $R^2$, $R^3$ or $R^4$ is benzyl.

The preferred alkyl chain length for $R^1$ is $C_{12}$-$C_{15}$, particularly where the alkyl group is a mixture of chain lengths derived from coconut or palm kernel fat or is derived synthetically by olefin build up or OXO alcohols synthesis. Preferred groups for $R^2$, $R^3$, and $R^4$ are methyl and hydroxyethyl groups and the anion X may be selected from halide, methosulphate, acetate and phosphate ions.

Nonionic Surfactants

Examples of suitable nonionic surfactants include alkyl polyglucosides ("APGs"), alcohol ethoxylates, nonylphenol ethoxylates, and others. The nonionic surfactant may be used as from 1% to 90%, more preferably from 1 to 40% and most preferably between 1% and 32% of a detergent composition.

Very suitable as nonionic surfactants are poly hydroxy fatty acid amide surfactants of the formula $$R^2—C(O)—N(R^1)—Z$$

where $R^1$ is H, or $R^1$ is $C_{1-4}$ hydrocarbyl, 2-hydroxyethyl, 2-hydroxypropyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Highly preferred nonionics are amine oxide surfactants. The compositions of the present technology may comprise amine oxide in accordance with the general formula:

$$R^1(EO)_x(PO)_y(BO)_zN(O)(CH_2R')_2.H_2O$$

In general, it can be seen that the preceding formula provides one long-chain moiety $R^1(EO)_x(PO)_y(BO)_z$ and two short chain moieties, —$CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having a chain length of from about 8 to about 18. When x+y+z is different from 0, $R^1$ may be somewhat longer, having a chain length in the range $C_{12}$-$C_{24}$. The general formula also encompasses amine oxides where x+y+z=0, $R^1$ is $C_8$-$C_{18}$, R' is H and q=from 0 to 2, preferably 2. These amine oxides are illustrated by $C_{12-14}$ alkyldimethyl amine oxide, hexadecyl dimethylamine oxide, octadcylamine oxide and their hydrates, especially the dihydrates as disclosed in U.S. Pat. Nos. 5,075,501 and 5,071,594, which are incorporated herein by reference.

Ampholytic Surfactants

Ampholytic synthetic detergents can be broadly described as derivatives of aliphatic or aliphatic derivatives of heterocyclic secondary and tertiary amines, in which the aliphatic radical may be straight chain or branched and where one of the aliphatic substituents contains from about 8 to about 18 carbon atoms and at least one contains an anionic water-solubilizing group, e.g., carboxy, sulfo, sulfato, phosphato, or phosphono (see U.S. Pat. No. 3,664,961, which provides specific examples of ampholytic surfactants from col. 6, line 60, to col. 7, line 53, incorporated here by reference). Examples of suitable ampholytic surfactants include fatty amine oxides and fatty amidopropylamine oxides. A specific suitable example is cocoamidopropyl betaine (CAPB) also known as coco betaine. Ampholytic surfactants can be used at a level from 1% to 50%, more preferably from 1% to 10%, even more preferably between 1% and 5% of the formulation, by weight.

Zwitterionic Surfactants

Zwitterionic synthetic detergents can be broadly described as derivatives of aliphatic quaternary ammonium and phosphonium or tertiary sulfonium compounds, in which the cationic atom may be part of a heterocyclic ring, and in which the aliphatic radical may be straight chain or branched, and where one of the aliphatic substituents contains from about 3 to 18 carbon atoms, and at least one aliphatic substituent contains an anionic water-solubilizing group, e.g., carboxy, sulfo, sulfato, phosphato, or phosphono. (see U.S. Pat. No. 3,664,961, which provides specific examples of zwitterionic surfactants from col. 7, line 65, to col. 8, line 75, incorporated here by reference). Zwitterionic surfactants can be used as from 1% to 50%, more preferably from 1% to 10%, even more preferably from 1% to 5% by weight of the present formulations.

Foam Stabilizing Surfactants

Certain embodiments of the present technology, including but not limited to LDL detergent formulations, can contain foam stabilizing surfactants in amounts of from about 0.5% to about 15% by active weight; alternatively, from about 3% to about 10% by active weight; alternatively about 5% by active weight based on the total actives ingredient weight of the composition.

Preferred foam stabilizing surfactants of the present technology can include Amphosol CA (cocoamidopropyl betaine), Ammonyx LMDO (lauryl myristal amidopropyl dimethyl amine oxide), Ammonyx LO (lauryl dimethyl amine oxide) all from the Stepan Company, Northfield, Ill., as well as Glucopon 600 (alkyl polyglucoside), and Glucopon 425 N (alkyl polyglucoside), both from the Cognis Company, Monheim Germany.

Mixtures of Surfactants

Mixtures of any two or more individually contemplated surfactants, whether of the same type or different types, are contemplated herein.

In addition to the surfactants as previously described, a laundry detergent composition commonly contains other ingredients for various purposes. Some of those ingredients are also described below.

Builders and Alkaline Agents

Builders and other alkaline agents are contemplated for use in the present formulations.

Any conventional builder system is suitable for use here, including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders could also be used here.

Suitable polycarboxylate builders for use here include citric acid, preferably in the form of a water-soluble salt, and derivatives of succinic acid of the formula:

$$R—CH(COOH)CH_2(COOH)$$

where R is $C_{10-20}$ alkyl or alkenyl, preferably $C_{12-16}$, or where R can be substituted with hydroxyl, sulfo sulfoxyl or sulfone substituents. Specific examples include lauryl succinate, myristyl succinate, palmityl succinate 2-dodecenylsuccinate, or 2-tetradecenyl succinate. Succinate builders are preferably used in the form of their water-soluble salts, including sodium, potassium, ammonium and alkanolammonium salts. Other builders contain sodium citrate dihydrate, monoethanolamine, and triethanolamine. Other suitable polycarboxylates are oxodisuccinates and mixtures of tartrate monosuccinic and tartrate disuccinic acid, as described in U.S. Pat. No. 4,663,071.

Especially for a liquid detergent composition, suitable fatty acid builders for use here are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid and citric acid.

Some examples of alkaline agents include alkalic metal (Na, U, or $NH_4$) hydroxides, carbonates, bicarbonates. Another commonly used builder is borax.

For powdered detergent compositions, the builder or alkaline agent typically comprises from 1% to 95% of the composition. For liquid compositions, the builder or alkaline agent typically comprises from 1% to 60%, alternatively between 1% and 30%, alternatively between 2% and 15%. See U.S. Pat. No. 5,929,022; column 7, start of 2nd paragraph through column 7, end of 6th paragraph, from which much of the preceding discussion comes. Other builders are described in PCT Publ. WO 99/05242, which is incorporated here by reference.

Enzymes

The sulfonated estolide formulations of the present technology may further comprise one or more enzymes, which provide cleaning performance and/or fabric care benefits. Suitable enzymes may be selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, beta-glucanases, arabinosidases or mixtures thereof.

The above-mentioned enzymes may be of any suitable origin, such as vegetable, animal, bacterial, fungal and/or yeast origin. See U.S. Pat. No. 5,929,022; column 7, 7th paragraph through column 9, 6th paragraph, from which much of the preceding discussion comes. Preferred compositions optionally contain a combination of enzymes or a single enzyme, with the amount of each enzyme commonly ranging from 0.0001% to 2%.

Other enzymes and materials used with enzymes are described in PCT Publ. WO99/05242, which is incorporated here by reference.

Adjuvants

The sulfonated estolide formulations of the present technology optionally contain one or more soil suspending agents or resoiling inhibitors in an amount from about 0.01% to about 5% by weight, alternatively less than about 2% by weight. Resoiling inhibitors include anti-redeposition agents, soil release agents, or combinations thereof. Examples of suitable agents are described in U.S. Pat. No. 5,929,022; column 10, 3rd paragraph through column 10, 5th paragraph, and include water-soluble ethoxylated amines having clay soil removal and anti-redeposition properties. Examples of such soil release and anti-redeposition agents given in the referenced patent include an ethoxylated tetraethylenepentamine. The ethoxylated amines further described in U.S. Pat. No. 4,597,898, VanderMeer, issued Jul. 1, 1986, are incorporated here by reference. Another group of preferred clay soil removal/anti-redeposition agents are the cationic compounds disclosed in European Patent Application 111,965, Oh and Gosselink, published Jun. 27, 1984, incorporated here by reference. Other clay soil removal/anti-redeposition agents which can be used include the ethoxylated amine polymers disclosed in European Patent Application 111,984, Gosselink published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985, all of which are incorporated here by reference.

Other common cleaning adjuncts are identified in U.S. Pat. No. 7,326,675, col. 12, and PCT Publication WO 99/05242 (Pages 29-56). Such cleaning adjuncts are identified as including bleaches, bleach activators, suds boosters, dispersant polymers (e.g., from BASF Corp. or Rohm & Haas) other than those described above, color speckles, silvercare, anti-tarnish and/or anti-corrosion agents, pigments, dyes, fillers, germicides, hydrotropes, anti-oxidants, enzyme stabilizing agents, pro-perfumes, carriers, processing aids, solvents, dye transfer inhibiting agents, brighteners, structure elasticizing agents, fabric softeners, anti-abrasion agents, and other fabric care agents, surface and skin care agents. Suitable examples of such other cleaning adjuncts and levels of use are found in U.S. Pat. Nos. 5,576,282, 6,306,812 B1 and 6,326,348 B1 and PCT Publ. WO99/05242.

EXAMPLES

The compositions of the present technology are illustrated by the following examples. Examples stated in the present or future tense are not represented as having been carried out.

Example 1

Preparation of a Bleached Aqueous Concentrate of Sulfo-Estolide (SE) Sodium Salts The feedstock used in this example had an equivalent weight of about 270.18 and was comprised of about 78% C-18:1, about 12% C-18:2, and about 9% saturated fatty acids. The feedstock was sulfonated on a falling film reactor at a rate of about 129.9 lbs per hour using a molar ratio of $SO_3$ to alkene functionality of about 0.95. The SE sulfonic acid was continuously neutralized in a loop reactor with concurrent addition of about 36.8 lbs per hour of 50% aqueous NaOH and about 26.9 lbs per hour of water. The temperature of the reaction mixture in the loop reactor was about 50° C. Neutralized SE solution was transferred to a stirred tank reactor and warmed to 80° C. Once at this temperature, four additions of 5.9 lbs of 50% aqueous hydrogen peroxide were added to the reactor over a 1.5 hour period. The total hydrogen peroxide charge was about 23.6 lbs. (about 3% active hydrogen peroxide by wt.). The pH of the SE solution was maintained around 5.8 throughout the process by the addition of 50% aqueous NaOH. After the final addition of hydrogen peroxide, the solution was stirred at about 85° C. for 2 hours and then the temperature was slowly raised to about 97° C. This temperature was maintained until the residual active peroxide had dropped to about 0.085% by wt. The solution was cooled and about 1.38 lbs of 40% aqueous sodium bisulfite was added to reduce the amount of residual active peroxide. The SE produced from this reaction was at a pH of about 5.69, was comprised of about 68.22% solids and about 5-10 ppm active peroxide, and had a Klett color at 5 percent solids concentration of 71.

Example 2

The following Heavy Duty Liquid (HDL) laundry detergents were made:

| | % inclusion by weight (Based on 100% active material) | |
|---|---|---|
| Ingredient | Formula 1 | Formula 2 |
| sodium $C_{16}$ methyl ester sulfonate | 6.5 | 6.5 |
| sodium SE | 6.5 | |
| potassium SE | | 6.5 |
| $C_{12-15}EO_7$ | 10.0 | 10.0 |
| deionized water | to 100 | |

pH was targeted at 8.0 and adjusted up or down as needed with NaOH or HCl, respectively. The ingredients are listed on a "100% Active" basis, meaning that the listed weight percentage is not diluted but rather 100% of the ingredient. Water is used to bring the total weight up to 100%.

Formula 1 was perfectly clear with no precipitate while Formula 2 was completely opaque with significant precipitate uniformly suspended in solution.

Example 3

Further HDL formulas were made:

| | % inclusion by weight (Based on 100% active material) | |
|---|---|---|
| Ingredient | Formula 3 | Formula 4 |
| sodium $C_{16}$ methyl ester sulfonate | 6.0 | 6.0 |
| sodium SE | 6.0 | |
| potassium SE | | 6.0 |
| sodium linear alkyl benzene sulfonate | 1.0 | 1.0 |
| $C_{12-15}EO_7$ | 10.0 | 10.0 |
| deionized water | to 100 | |

pH was targeted at 8.0 and adjusted up or down as needed with NaOH or HCl, respectively.

Formula 3 was perfectly clear with no precipitate while Formula 4 was completely opaque with significant precipitate uniformly suspended in solution.

Example 4

More concentrated HDLs were also made:

| | % inclusion by weight (Based on 100% active material) | |
|---|---|---|
| Ingredient | Formula 5 | Formula 6 |
| sodium $C_{16}$ methyl ester sulfonate | 9.0 | 9.0 |
| sodium SE | 11.0 | |
| potassium SE | | 11.0 |
| sodium alkyl benzene sulfonate | 1.5 | 1.5 |
| $C_{12-15}EO_7$ | 20.0 | 20.0 |
| deionized water | to 100 | |

pH was targeted at 8.0 and adjusted up or down as needed with NaOH or HCl, respectively.

Formula 5 was perfectly clear with no precipitate while Formula 6 was completely opaque with significant precipitate uniformly suspended in solution.

Analogous formulations corresponding to Formulas 1, 3 and 5 but using the ammonium or lithium salt of sulfo-estolide instead of the sodium salt are also contemplated.

Example 5

The following prophetic formulas, in Table 1, are intended to cover liquid laundry detergent formulas. Unless more narrowly defined in the table, the pH of these formulas is between a pH of about 7 to about 10, preferably between about 7.5 to about 9.5 and most preferably between about 8.5 to about 9.0. These formulas are not intended to be limiting in any way—optional ingredients described herein regarding the present technology can be added in the proportions described. In each case, these are intended to be liquid detergent formulas and, after the addition of optional ingredients, water would be used to bring the total weight up to 100%.

TABLE 4

| Ingredient* | % Inclusion by Weight (Based on 100% Active) | | | | | | | |
|---|---|---|---|---|---|---|---|---|
| | A | B | C | D | E | F | G | H |
| Sodium SE | 6.4 | 12.4 | 12.4 | 10.4 | 25 | 27 | 25 | 27 |
| Nonionic surfactant | | | | | | | | |
| AES | 6 | | | | | | | |
| C16MES | 4 | 4 | 4 | 4 | 11 | 11 | 11 | 11 |
| Cocoamide DEA | 9.8 | 9.8 | 9.8 | 9.8 | 17 | 17 | 10 | 10 |
| AMMONYX ® LO | | | | 2 | 2 | | 2 | |
| $C_{12}EO_3$ | | | | | | | 7 | 7 |
| Coconut fatty acid | | | | | | | | |
| Borax pentahydrate | 1.7 | 1.7 | | 1.7 | 1.2 | 1.2 | 1.2 | 1.2 |
| Propylene glycol | | | | | | | | |
| Calcium chloride | | | 0.15 | | | | | |
| Glycerol | 4.6 | 4.6 | 5.5 | 4.6 | 3 | 3 | 3 | 3 |
| Sodium citrate | | | | | | | | |
| Triethanolamine | | | | | | | | |
| Monoethanolamine | | | | | | | | |
| Fluorescent whitening agent (FWA) | 0.15 | 0.15 | 0.15 | 0.15 | 0.15 | 0.2 | 0.2 | 0.2 |
| Anti-redeposition agent | | | | | | | | |
| Thickener | 0.1 | 0.25 | 0.25 | 0.25 | | | | |
| Thinner | | | | | | | | |
| Protease | 0.6 | 0.6 | 0.6 | 0.6 | 1 | 1 | 1 | 1 |
| Amylase | 0.3 | 0.3 | 0.3 | 0.3 | 0.5 | 0.5 | 0.5 | 0.5 |
| Lipase | | | | 0.2 | | | | |
| Mannanase | | | | 0.1 | | | | |
| Cellulase | | | | 0.02 | | | | |
| pH | | | | | | | | |

*A preferred nonionic surfactant is BIO-SOFT ® N25-7, Stepan Company. A preferred AES is STEOL ®CS-460, Stepan Company. A preferred FWA is TINOPAL CBS-X, Ciba. A preferred thickener is Cellosize QP 100MH, Dow. Preferred thinners include: $C_{12}EO_2$, $C_{12}EO_3$ (in addition to that already included in certain formulas in the table), ethanol, isopropanol, sodium xylene sulfonate, sodium cumene sulfonate, 2-methoxy ethanol, 2-butoxyethanol, methoxy ethoxy ethanol and combinations of these. A preferred preservative for these formulas is Neolone M-10 from Rohm and Haas used at 75 ppm on a 100% active basis.

The embodiments and examples described here are illustrative, and do not limit the presently described technology in any way. The scope of the present technology described in this specification is the full scope defined or implied by the claims.

The invention claimed is:

1. A liquid cleaning composition, comprising:

at least one compound having the following Formula 1:

Formula 1

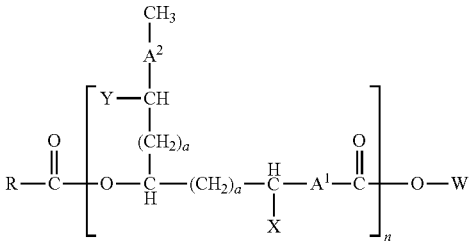

wherein n is an integer from 1-30;

one of X and Y is $SO_3$—Z, the other of X and Y is H, and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or un-substituted, wherein the total number of carbon atoms is from about 1 to about 24;

W is a cation selected from the group consisting of sodium, lithium, ammonium and mixtures thereof;

Z is a cation selected from the group consisting of sodium, lithium, ammonium and mixtures thereof;

at least one alkyl ester sulfonate surfactant;

wherein the liquid composition is substantially free of settled precipitation, and has a percent transmittance of greater than about 50 at 570 nanometers measured in the absence of dyes and opacifiers, at 25 degrees Celsius.

2. The composition of claim 1 wherein W and Z are sodium cations.

3. The composition of claim 1 wherein the composition has a total, combined amount of saturated C16 and C18 fatty acid, or soap thereof, of less than about 5% by weight.

4. The composition of claim 1 wherein the composition has a total, combined amount of saturated C16 and C18 fatty acid, or soap thereof, of less than about 3% by weight.

5. The composition of claim 1 wherein the composition has a total, combined amount of saturated C16 and C18 fatty acid, or soap thereof, of less than about 1% by weight.

6. The composition of claim 1 wherein the Formula 1 compound is present in the composition in an amount of about 1% to about 50% by weight, the alkyl ester sulfonate is present in the composition in amount of about 1% to about 40% by weight, and the composition further comprises about 10% to about 98% water.

7. The composition of claim 1 further comprising at least one additional component.

8. The composition of claim 7 wherein the additional component is selected from the group consisting of surfactants, builders, alkaline agents, enzymes, adjuvants, cleaning adjuncts, perfumes, dyes and mixtures thereof.

9. The composition of claim 8 wherein the surfactant is selected from anionic, cationic, nonionic, ampholytic and zwitterionic surfactants, and mixtures thereof.

10. The composition of claim 9 wherein the surfactant is selected from the group consisting of alcohol ethoxylates, alkyl polyglucosides, alkyl ether sulfates, linear alkyl benzene sulfonates and mixtures thereof.

11. The composition of claim 1 wherein the alkyl ester sulfonate is selected from the group consisting of substantially C12 alpha methyl ester sulfonate, substantially C16 alpha methyl ester sulfonate, and a blend of C12 to C18 alpha methyl ester sulfonates.

12. A liquid cleaning composition comprising:

at least one compound having the following Formula 1:

Formula 1

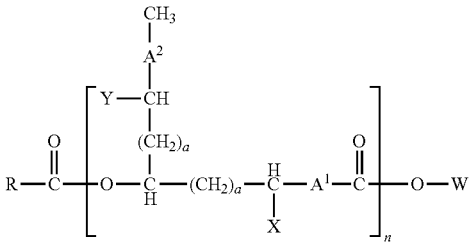

wherein n is an integer from 1-30;

one of X and Y is $SO_3$—Z, the other of X and Y is H, and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or un-substituted, wherein the total number of carbon atoms is from about 1 to about 24;

W is sodium, lithium, ammonium, alkyl group, substituted alkyl group, or a mixture thereof;

Z is sodium, lithium, ammonium, substituted ammonium, or a mixture thereof;

at least one alkyl ester sulfonate surfactant; and water, wherein the liquid composition has a total combined amount of saturated C16 and C18 fatty acid, or soap thereof, of less than about 5% by weight, and wherein the liquid composition is substantially free of settled precipitation, and has a percent transmittance of greater than about 50 at 570 nanometers measured in the absence of dyes and opacifiers, at 25° Celsius.

13. The composition of claim 12, wherein the alkyl ester sulfonate surfactant is selected from the group consisting of predominantly C12 alpha methyl ester sulfonate, predominantly C16 alpha methyl ester sulfonate, a blend of predominantly C12 alpha methyl ester sulfonate and predominantly C16 alpha methyl ester sulfonate, and a blend of C12 to C18 alpha methyl ester sulfonates.

* * * * *